United States Patent [19]

Wirges

[11] 4,096,785

[45] Jun. 27, 1978

[54] ELASTIC COLUMN OF ADJUSTABLE LENGTH

[75] Inventor: Winfried Wirges, Koblenz, Germany

[73] Assignee: Stabilus GmbH, Koblenz, Germany

[21] Appl. No.: 697,980

[22] Filed: Jun. 21, 1976

[30] Foreign Application Priority Data

Jun. 28, 1975 Germany ..... 2528980

[51] Int. Cl.[2] ..... F15B 15/17; F16J 1/10

[52] U.S. Cl. ..... 91/416; 91/165; 91/417 R; 92/84; 92/134

[58] Field of Search ..... 92/65, 84, 134; 91/416, 91/376, 422, 437, 438, 439, 436, 165, 166

[56] References Cited

U.S. PATENT DOCUMENTS

| | | | |
|---|---|---|---|
| 2,875,732 | 3/1959 | Hoffmann | 91/436 |
| 3,210,941 | 10/1965 | Stelzer | 92/65 |
| 3,450,005 | 6/1969 | Ellis | 92/65 |
| 3,606,983 | 9/1971 | Mitchell | 92/65 |
| 3,628,422 | 12/1971 | Acre | 91/376 R |
| 3,754,450 | 8/1973 | Putt et al. | 91/376 R |
| 3,828,651 | 8/1974 | Dorner | 91/416 |

FOREIGN PATENT DOCUMENTS

| | | |
|---|---|---|
| 1,164,155 | 9/1969 | United Kingdom. |
| 1,173,916 | 12/1969 | United Kingdom. |

*Primary Examiner*—Paul E. Maslousky
*Attorney, Agent, or Firm*—Hans Berman

[57] ABSTRACT

A column including a cylinder, a piston axially slidable in the cylinder cavity, a piston rod axially projecting from the cylinder, and a valve permitting selective communication between the two compartments of the cylinder cavity separated by the piston for flow of fluid between the compartments is additionally provided with a helical compression spring coiled about the piston rod and impeding axial movement of the piston on the piston rod in one direction, movement in the other direction being limited by a radial abutment flange on the piston rod. The spring favorably affects the comfort of a chair whose seat is mounted on the column.

15 Claims, 2 Drawing Figures

ELASTIC COLUMN OF ADJUSTABLE LENGTH

This invention relates to axially elastic columns of adjustable height which have a cylinder, a piston axially slidable in the cylinder cavity, a piston rod secured to the piston and axially projecting from the cylinder, and a valve which may connect the two compartments of the cylinder cavity for flow of a fluid, the compartments being sealed from each other when the valve is closed and separated by the piston. The invention more particularly relates to an improvement in the elastic properties of such columns.

The fluid in the known columns is either a gas at a pressure higher than atmospheric pressure, or a liquid under the pressure of a gas cushion. The elastic characteristics of such a column are such that a stool or chair employing the column as a seat support offers limited comfort.

To overcome this inconvenience, it has been proposed in French Pat. No. 1,386,907 to arrange a helical compression spring in parallel with the pneumatic spring constituted by the conventional adjustable column, but the initial rate of response of the compression spring interposed between the piston and the cylinder is greatly affected by the position of the piston. When the column is fully extended, the spring is nearly completely relaxed and adds little to the resistance of the column to an applied load. When the column is near its minimum length, the spring may make a supported seat harder than would be desirable.

It is a primary object of this invention to modify the spring characteristics of a column of the type described in a more uniform manner regardless of the column height.

With this object and others in view, as will hereinafter become apparent, the piston rod in the column of the invention is secured to the piston in the cylinder cavity for relative axial movement. Yieldably resilient means abuttingly interposed between the piston and the piston rod impede such relative movement.

Figure 1:
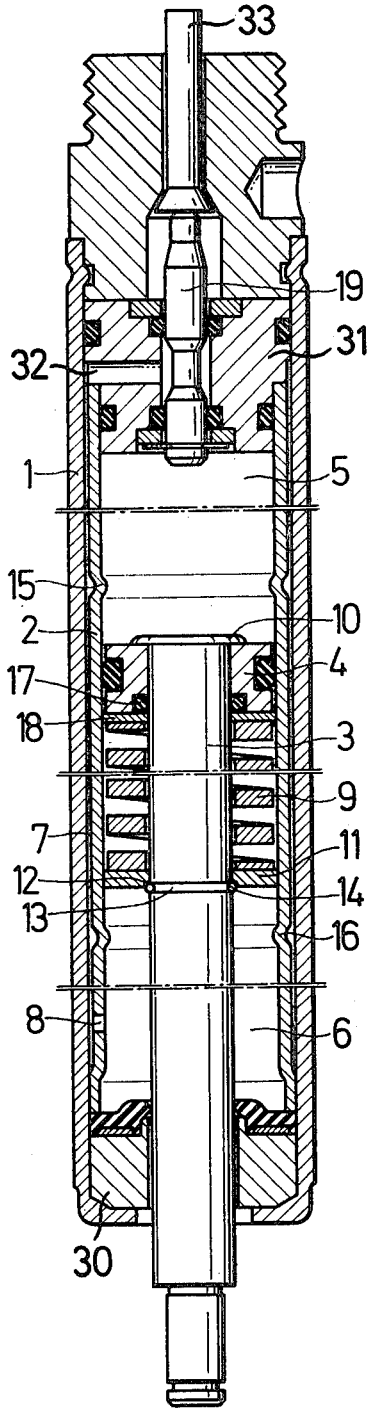
Figure 2:
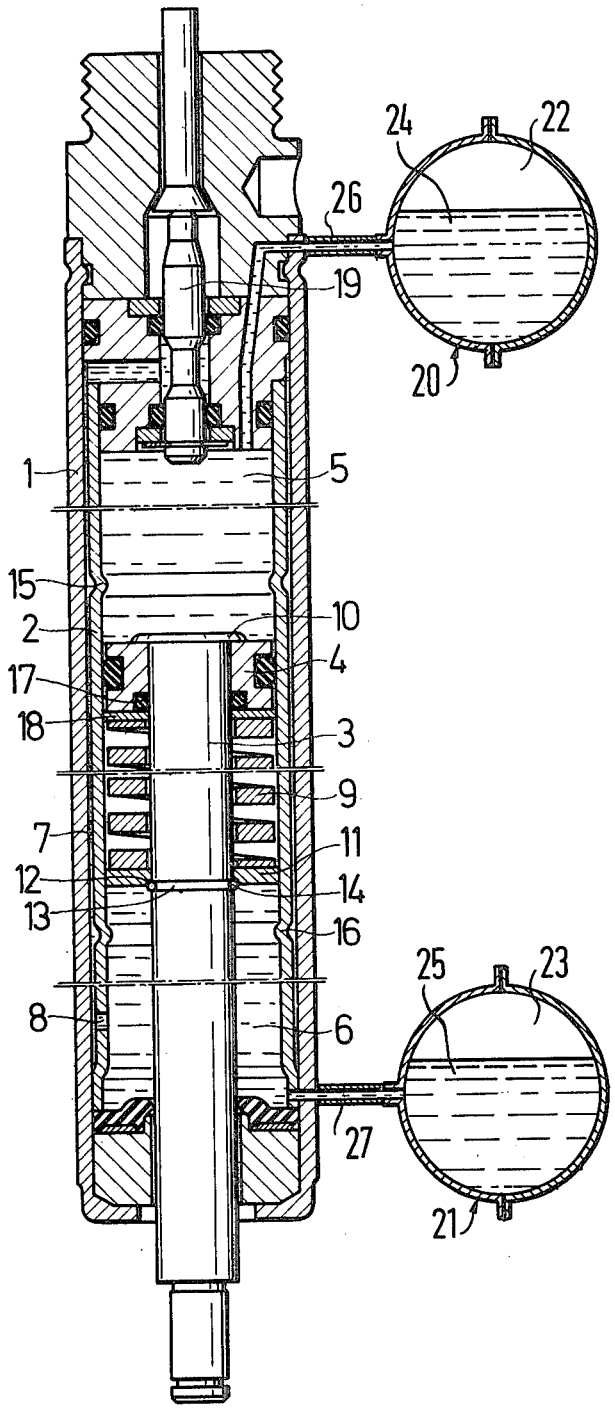

Other features, additional objects, and many of the attendant advantages of this invention will readily be appreciated as the same becomes better understood by reference to the following detailed description of preferred embodiments when considered in connection with the appended drawing in which:

FIG. 1 shows a resilient, adjustable column of the invention in elevational section on its longitudinal axis; and FIG. 2 illustrates a modification of the column of FIG. 1 in a corresponding view.

Referring now to the drawing in detail, and initially to FIG. 1, there is seen a shell 1 having the shape of a generally cylindrical, axially tall cup whose top is closed by a plug assembly 31. A valve operating rod 33 projects axially from a bore in the plug assembly 31, and a piston rod 3 projects in the opposite axial direction from an opening in the bottom of the shell 1 through another plug assembly 30.

The shell 1 spacedly envelops a coaxial cylinder 2 of generally circular cross section whose central cavity is axially divided into compartments 5, 6 by a sliding piston 4. The annular space 7 between the shell 1 and the cylinder 2 connects radial bores 8 in the cylinder 2, permanently open to the compartment 6, with radial bores 32 in the plug assembly 31, only one bore 8, 32 being shown for the convenience of pictorial representation. A valve 19 in the plug assembly 31 may be moved by the operating rod 33 between the illustrated position in which it seals the compartments 5, 6 from each other to an open position in which it permits flow of fluid through the bores 32, the space 7, and the bores 8 between the compartments which are filled with compressed air or compressed nitrogen.

The structure described so far is conventional and operates in a well known manner. If the piston rod 3 is mounted upright on the base of a stool, and the seat of the stool is attached to the plug assembly 31, the seat assumes a position determined by the weight of the shell 1 and of masses fastened thereto in weight-transmitting relationship and by the compressibility of the gas in the compartment 5. When the weight is increased, the column is shortened by compressing the gas. If a major change in the length of the column is desired, the valve 19 is moved to the open position, and gas is permitted to flow between the compartments 5, 6 to expel the piston rod 3 or to permit its further penetration into the cylinder 2.

The piston 4 has a central, axial bore in which the inner end of the piston rod 3 is axially movably received. A heavy, helical compression spring 9, coiled about the piston rod 3, biases the piston 4 into abutting engagement with a radial flange 10 at the free end of the piston rod 3. The end of the spring 9 remote from the piston 4 is seated on a washer 11, a flat, annular disc whose outer diameter is only slightly smaller than the inner diameter of most of the inner wall of the cylinder 2. The inner diameter of the spring seating washer 11 is sufficiently greater than the diameter of the cylindrical piston rod 3 to permit axial washer movement on the piston rod. A circumferential edge 12 bounding the central opening in the washer 11 is beveled for conforming engagement with a split ring 14 of steel wire partly received in a circumferential groove 13 of the piston rod 3. The wire ring 14 thus backs the seating washer 11 and limits its downward movement to the illustrated position into which it is biased by the spring 9.

The piston 4 may move axially upward from the illustrated position until it is arrested by a circumferential rib 15 projecting radially inwardly from an otherwise cylindrical wall portion of the cylinder 2. With the piston arrested, the piston rod 3 may continue upward movement against the resilient restraint of the spring 9. Similarly, a circumferential rib 16 in the cylinder wall holds the washer 11 when the piston rod 3 together with the piston 4 moves downward from the position shown in FIG. 1 while axial downward movement of the piston rod, the piston, and the backing ring 14 may continue against the restraint of the spring 9, the ring 14 thereby moving axially downward past the washer 11. The ribs 15, 16 are formed in the cylinder 2 by rolling grooves in the outer cylinder walls.

Packings and seals are provided between the plug assemblies 30, 31, the cylinder 2, and the piston rod 3, as is partly illustrated in the drawing and too well known to require explicit description, and a sealing ring on the piston 4 movably engages the cylinder 2 as is conventional. A tight seal between the piston rod 3 and the piston 4 is formed at the central bore of the piston. The orifice of the bore axially open toward the compartment 6 is radially enlarged to receive a sealing ring 17 of synthetic rubber. Another seating washer 18 dimensionally closely similar to or identical with the washer 11 described above is interposed between the spring 9 and the bottom face of the piston 4 so as to compress the initially toroidal sealing ring 17 in an axial direction and thereby to hold it engaged radially with the piston rod 3. Excessive deformation of the sealing ring is prevented by abutting axial engagement of the washer 18 with the rigid piston face extending about the ring 17.

The spring 9 and the gas pressure in the cylinder cavity are chosen in such a manner that the gas cannot significantly compress the spring 9 when the valve 19 is opened while the non-illustrated seat of the stool or chair is not occupied. Opening of the valve 19 causes the piston rod 3 to be expelled from the cylinder 2, and gas to flow from the contracting compartment 6 into the expanding compartment 5 until the washer 11 is held fast by the rib 16, and movement of the piston rod 3 relative to the cylinder 2 comes to a halt. When the valve 19 is closed, and the non-illustrated seat then is loaded, the piston rod 3 is pushed inward of the cylinder 2, and the gas in the compartment 5 is compressed. The spring characteristic of the column is determined by the compressibility of the gas alone unless the load is sufficiently great to cause relative movement of the piston 4 and the piston rod 3 against the restraint of the spring 9. For a column having a given axial length when fully expanded, the range of elastic movement is greater than in the absence of the spring 9.

When the column is compressed at open valve 19, the piston 4 is ultimately arrested by the rib 15. When the valve 19 is closed at this stage, the column still responds elastically to changes in the applied load by compression and expansion of the spring 9.

The column shown in FIG. 2 combines all the structural elements shown in FIG. 1 in the manner described above. However, the cavity of the cylinder 2 is filled with non-compressible liquid, and the compartments 5, 6 respectively communicate with expansion chambers 20, 21 partly filled with cushions of compressed gas 22, 23, and partly with liquid 24, 25. Conduits 26, 27 communicate with the chambers 20, 21 below the gas-liquid interfaces and connect the respective liquid bodies in the chambers 20, 21 with the compartments 5, 6. The conduits 26, 27 add their throttling effect to that of the ducts 8 and thereby affect the elastic characteristics of the column shown in FIG. 2, but the basic mode of operation is unchanged Other modifications of the apparatus illustrated in FIG. 1 will readily suggest themselves. Thus, the spring 9 may be replaced by a gas cushion sealed from the compartment 6 by a floating piston replacing the washer 11 and movably sealed to the cylinder 2 and the piston rod 3 in a manner obvious from the showing of the piston 4. Alternatively, small, individual pneumatic springs may be distributed about the piston rod 3 between the washers 11, 18, and multiple, helical compression springs may replace such pneumatic springs without basic change in the operation of the column.

The illustrated sealing ring 17 relies on the axial pressure of the washer 18 for tight engagement with the piston rod 3, and such an arrangement is preferred. The spring 9, therefore, must be selected and installed in such a manner that it is under compressive stress in all operative positions of the piston 4 and thus maintains positive contact pressure between the piston 4 and the engaged abutment flange 10. A spring fully relaxed in a terminal piston position may be used if the piston rod 3 is sealed to the piston 4 in a manner different from that shown in the drawing, a suitable, alternative, sealing arrangement being shown between the piston 4 and the cylinder 2.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the appended claims.

What is claimed is:

1. A column of adjustable height comprising:

(a) a cylinder member having an axis and enclosing a cavity;

(b) a piston member axially slidable in said cavity and axially dividing the cavity into two compartments sealed from the ambient atmosphere;

(c) valve means operatively interposed between said compartments;

(d) valve operating means for moving said valve means toward and away from an open position in which said valve means connect said compartments, (1) said valve operating means including an operating member having a manually movable portion outside said cavity in said atmosphere, (2) said operating member being connected to said valve means for moving the same when said portion of the operating member is moved.

(3) said valve means sealing said compartments from each other when away from said open position;

(e) a piston rod member secured to said piston member for relative axial movement and extending axially outward of said cavity in movable, sealing engagement with said cylinder member;

(f) a fluid under a pressure higher than atmospheric pressure filling said compartments; and (g) yieldably resilient means abuttingly interposed between said piston member and said piston rod member for impeding said relative movement.

2. A column as set forth in claim 1, further comprising abutment means axially fixed on said piston rod member for limiting axial movement of said piston member relative to said piston rod member in one direction, said yieldably resilient means permanently biasing said piston member toward a position of axial engagement by said abutment means.

3. A column as set forth in claim 2, wherein said abutment means include an abutment member, and said yieldably resilient means include means maintaining contact pressure between said piston member and said abutment member in said position of axial engagement.

4. A column as set forth in claim 1, further comprising arresting means on said cylinder member for arresting axial sliding of said piston member relative to said cylinder member while permitting axial relative movement of said piston rod member and said piston member.

5. A column as set forth in claim 1, further comprising a seating member axially movably mounted on said piston rod member, said yieldably resilient means including a spring member axially interposed between said seating member and said piston member for biasing said seating member in direction axially away from said piston member, backing means on said piston rod member preventing axial movement of said seating member away from said piston member beyond a predetermined position, and holding means on said cylinder member holding said seating member in a position fixed relative to said cylinder member against the biasing force of said yieldably resilient means when said backing member moves axially past said holding member in a direction away from said piston member.

6. A column as set forth in claim 5, wherein said seating member is an annular disc, and said backing means including a ring axially secured on said piston rod member for engagement by said disc.

7. A column as set forth in claim 6, wherein said disc has an inner circumferential edge bounding a central opening in said disc, said edge being beveled for conforming engagement by said ring.

8. A column as set forth in claim 5, wherein said cylinder member has an inner, axial wall of circular cross section, said holding means projecting from said wall in a radially inward direction.

9. A column as set forth in claim 8, wherein said cylinder member is formed with a circumferential rib constituting said holding means.

10. A column as set forth in claim 1, wherein said piston member is formed with an axial bore therethrough movably receiving said piston rod member, said bore having a radially enlarged orifice axially open toward one of said compartments, the column further comprising a sealing ring received in said orifice in sealing engagement with said piston rod, member and an annular seating member axially engaging said sealing ring and a portion of said piston member extending about said orifice, said yieldably resilient means biasing said seating member toward said sealing ring and toward said portion of the piston member.

11. A column as set forth in claim 1, said yieldably resilient means including a helical compression spring having a plurality of turns extending about said axis.

12. A column as set forth in claim 1, wherein sealing means are provided between said piston rod member and said piston member.

13. A column of adjustable height comprising:

(a) a cylinder member having an axis and enclosing a cavity;

(b) a piston member axially slidable in said cavity and axially dividing said cavity into two compartments;

(c) passage means connecting said compartments;

(d) a piston rod member secured to said piston member for relative axial movement and extending axially outward of said cavity in movable, sealing engagement with said cylinder member;

(e) a disc-shaped, annular seating member axially movably mounted on said piston rod member;

(f) a ring axially secured on said piston rod member for engagement by said seating member and preventing axial movement of said seating member away from said piston member beyond a predetermined position;

(1) said seating member having an inner circumferential edge bounding a central opening in said seating member, (2) said edge being beveled for conforming engagement by said ring;

(g) a spring member axially interposed in abutting engagement between said seating member and said piston member for biasing said seating member axially away from said piston member toward engagement with said ring;

(h) holding means on said cylinder member holding said seating member in a position fixed relative to said cylinder member against the biasing force of said spring member when said ring moves axially past said holding means in a direction away from said piston member; and (i) a fluid under a pressure higher than atmospheric pressure filling said compartments.

14. A column of adjustable height comprising:

(a) a cylinder member having an axis and an inner wall of circular cross section, said cylinder member enclosing a cavity;

(b) a piston member axially slidable in said cavity and axially dividing said cavity into two compartments;

(c) passage means connecting said compartments;

(d) a piston rod member secured to said piston member for relative axial movement and extending axially outward of said cavity in movable, sealing engagement with said cylinder member;

(e) a seating member axially movably mounted on said piston rod member;

(f) backing means on said piston rod member preventing axial movement of said seating member away from said piston member beyond a predetermined position;

(g) a spring member axially interposed in abutting engagement between said seating member and said piston member for biasing said seating member axially away from said piston member;

(h) a circumferential rib projecting from said inner wall in a radially inward direction for holding said seating member in a position fixed relative to said cylinder member against the biasing force of said spring member when said backing means moves axially past said rib in a direction away from said piston member; and (i) a fluid under a pressure higher than atmospheric pressure filling said compartments.

15. A column of adjustable height comprising:

(a) a cylinder member having an axis and enclosing a cavity;

(b) a piston member axially slidable in said cavity and axially dividing said cavity into two compartments;

(1) said piston member being formed with an axial bore therethrough, (2) said bore having a radially enlarged orifice axially open toward one of said compartments;

(c) passage means connecting said compartments;

(d) a piston rod member secured to said piston member in said bore for relative axial movement and extending outward of said cavity in movable sealing engagement with said cylinder member;

(e) a sealing ring received in said orifice in sealing engagement with said piston rod member;

(f) an annular seating member axially engaging said sealing ring and a portion of said piston member extending about said orifice;

(g) yieldably resilient means biasing said seating member toward said sealing ring and toward said portion of the piston member and thereby impeding relative axial movement of said piston rod member and of said piston member; and (h) a fluid under a pressure higher than atmospheric pressure filling said compartments.

* * * * *